US008033544B2

(12) United States Patent
Dondiego et al.

(10) Patent No.: US 8,033,544 B2
(45) Date of Patent: Oct. 11, 2011

(54) EDGE SENSOR CALIBRATION FOR PRINTMAKING DEVICES

(75) Inventors: Matthew Dondiego, West Milford, NJ (US); Lloyd A. Williams, Mahopac, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 141 days.

(21) Appl. No.: 12/633,012

(22) Filed: Dec. 8, 2009

(65) Prior Publication Data

US 2011/0133396 A1 Jun. 9, 2011

(51) Int. Cl.
*B65H 9/16* (2006.01)
*B65H 7/02* (2006.01)

(52) U.S. Cl. ..... 271/252; 271/228; 271/227

(58) Field of Classification Search ..... 271/252, 271/248, 249, 250, 227, 228
See application file for complete search history.

(56) References Cited

U.S. PATENT DOCUMENTS 5,094,442 A 3/1992 Kamprath et al.
6,168,153 B1 1/2001 Richards et al.
6,533,268 B2 3/2003 Williams et al.
6,575,458 B2 6/2003 Williams et al.
7,422,211 B2 9/2008 Dejong et al.
2011/0049793 A1 * 3/2011 deJong et al. ..... 271/227

OTHER PUBLICATIONS

U.S. Appl. No. 12/547,762, filed Aug. 26, 2009, "Edge Sensor Gain Calibration for Printmaking Devices."

* cited by examiner

*Primary Examiner* — Stefanos Karmis
*Assistant Examiner* — Luis A Gonzalez
(74) *Attorney, Agent, or Firm* — Hoffmann & Baron, LLP

(57) ABSTRACT

According to aspects illustrated herein, there is provided a printmaking device, a method, and a system for calibrating sensors. The printmaking device includes a calibration system with a media path, a registration device, and at least one edge sensor. The registration device having a pair of nips connected by a lateral carriage and a calibration member disposed traversely and affixed to the lateral carriage. The lateral carriage is configured to move laterally relative to the media path. The at least one edge sensor may be configured to determine an extent of movement of a first portion of the calibration member. The registration device calibrates the at least one edge sensor by: moving the lateral carriage a predetermined distance; determining the extent of movement of the first portion of the calibration member; and comparing the predetermined distance and the extent of movement so as to determine the calibration factor.

21 Claims, 8 Drawing Sheets

EDGE SENSOR CALIBRATION FOR PRINTMAKING DEVICES

FIELD OF THE INVENTION

This disclosure generally relates to a method and device for calibrating sensor output using a calibration member attached to a registration device. In particular, this disclosure provides for a method and device of calibrating the sensors often enough to provide sufficient precision in spite of any potential sensor drift and would permit the use of significantly lower cost sensors.

BACKGROUND

Sheet registration systems are well known in the art and used to control, correct, and change the orientation and/or position of a sheet. Sheet registration systems use nips to drive paper along a feed path. The nips consist of a driven wheel and an idler wheel. The nips are mounted with bearings on a shaft so that the nips can rotate and translate. An angular velocity is imported on each of the driven wheels with a motor, which may be connected directly to the driven wheels or may be connected through a transmission (e.g., a timing belt). The motor may be a stepper motor or a DC servo motor with encoder feedback from an encoder mounted on either the motor shaft, driven wheel shaft, or idler shaft. Only one encoder is necessary for each set of nips to control the angular velocity of the driven wheel. The other two encoders may or may not provide additional functionality, but could be removed to save costs.

The nips are mounted such that they can move in the y-direction. In the teachings of U.S. Pat. No. 5,094, 442, the inboard and outboard motors, nips, etc. are all mounted inside a carriage that can move in the y-direction. U.S. Pat. Nos. 6,533,268 and 6,585,458 disclose a different mechanism to allow a y-direction motor with an appropriate actuator. According to this method the sheet can move in three degrees of freedom, i.e. x-direction (or process), y-direction (or lateral), and angular (or skew). The average of the velocities of each of the nips impart the process velocity, the differences in the nip velocities impart the angular velocity, and the y-direction actuator imparts a lateral motion.

U.S. Pat. No. 7,422,211 provides an example of a method for closed loop feedback for skew and lateral registration. The method uses edge sensors to measure the lateral and skew positions of the sheet and feeds the information back to controllers which manipulate the lateral and skew actuator. The current devices, which may use the method of U.S. Patent '211 require the use of expensive sensors to obtain benchmark media registration accuracy. Although lower cost sensors may be used, the lower cost sensors do not exhibit consistent input/output properties.

Therefore, it is desirable to provide a method for calibrating edge sensors often and with a sufficient level of precision. Additionally, use of the method for calibrating edge sensors would allow for the use of low cost sensors capable of providing lateral registration of the sheet with high registration accuracy. Furthermore, there is a desire to use a calibration method with low cost sensors that can deliver better resolution than current registration methods by several orders of magnitude.

SUMMARY

According to aspects illustrated herein, there is provided a printmaking device. The printmaking device includes a calibration system with a media path, a registration device, and at least one edge sensor. The registration device having a pair of nips connected by a lateral carriage and a calibration member disposed traversely and affixed to the lateral carriage. The lateral carriage is configured to move laterally relative to the media path. The at least one edge sensor may be configured to determine an extent of movement of a first portion of the calibration member. The registration device calibrates the at least one edge sensor by: moving the lateral carriage a predetermined distance; determining the extent of movement of the first portion of the calibration member; and comparing the predetermined distance and the extent of movement so as to determine the calibration factor.

According to further aspects illustrated herein, there is provided a method for calculating a calibration factor for at least one edge sensor in a printmaking device. The method includes the following steps. First, providing a registration device along a media path. The registration device having a lateral carriage with a calibration member disposed traversely and affixed to the lateral carriage. The registration device further having at least one edge sensor configured to measure a lateral position of at least a portion of the calibration member with reference to the media path. Next, moving the lateral carriage a predetermined distance. Then, determining an extent of movement of a first portion of the calibration member. Finally, comparing the predetermined distance and the extent of movement so as to determine the calibration factor.

According to further aspects illustrated herein, there is provided a system for use with a printmaking device to calculate a calibration factor for at least one edge sensor. The system includes a media path, a registration device, and at least one edge sensor. The media path is adapted to transport a sheet. The registration device has a pair of nips connected by a lateral carriage and a calibration member disposed traversely and affixed to the lateral carriage. The lateral carnage is configured to move laterally relative to the media path. The at least one edge sensor is located along the media path and is configured to determine an extent of movement of a first portion of the calibration member. The registration device calibrates the at least one edge sensor by: moving the lateral carriage a predetermined distance; determining the extent of movement of the first portion of the calibration member; and comparing the predetermined distance and the extent of movement so as to determine the calibration factor.

Additional features and advantages will be readily apparent from the following detailed description, the accompanying drawings, and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
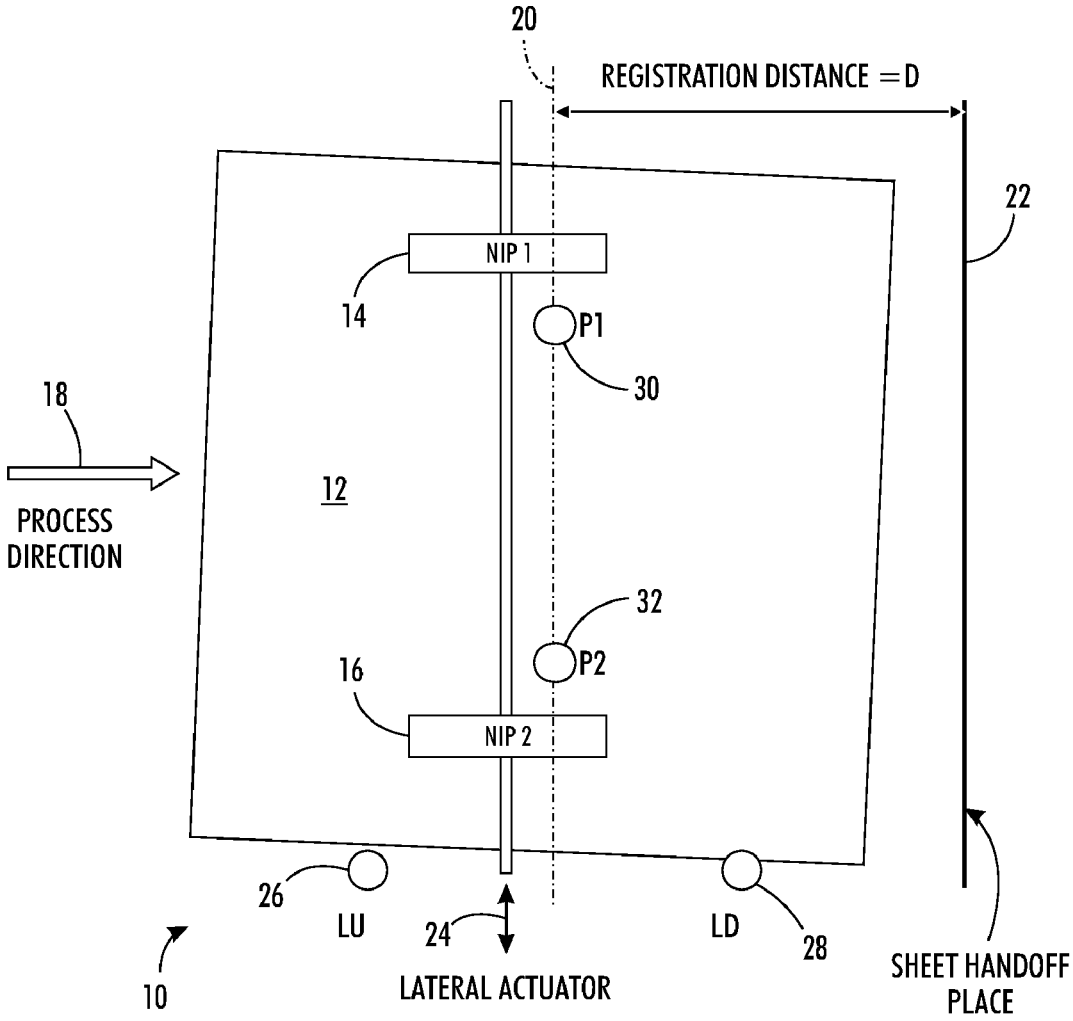
FIG. 1 PRIOR ART
FIG. 1 illustrates a prior art schematic diagram of a sheet registration system for use with a skew and lateral registration method.

A method, system, and printmaking device are disclosed herein for calibrating edge sensors using a lateral carriage with a calibration member disposed traversely and affixed to the lateral carriage. See also, U.S. patent application Ser. No. 12/547,762, filed Aug. 26, 2009, the contents of which are incorporated herein by reference (providing a method for calibrating edge sensors using a sheet of paper instead of a calibration member).

As used herein, the phrase "printmaking device" encompasses any apparatus, such as a digital copier, a bookmaking machine, a facsimile machine, and a multi-function machine, which use marking technologies to perform a printing outputting function for any purpose. Examples of devices using marking technologies include xerographic, inkjet, and offset marking. The printmaking devices may feed blank or preprinted sheets into devices that use marking technologies, but the printmaking device may not do any printing.

As used herein, the terms "sheet" or "media sheet" encompass, for example, one or more of a usually flimsy physical sheet of paper, heavy media paper, coated papers, transparencies, parchment, film, fabric, plastic, or other suitable physical print media substrate on which information can be reproduced.

As used herein, the phrase "media path" or "feed path" encompasses any apparatus for separating and/or conveying one or more sheets into a substrate conveyance path inside a printmaking device.

As used herein, the phrase "optical sensor" refers to a sensor that detects the intensity or brightness of light.

As used herein, the phrase "lateral carriage" refers to a device that is configured to move a calibration member laterally during registration of the calibration member.

As used herein, the phrase "calibration member" refers to an extension of the lateral carriage that is disposed traversely and affixed to the lateral carriage. The calibration member having a first portion that is configured to move laterally with the lateral carriage and across the edge sensors.

As used herein, the phrase "position transducer" refers to a device operatively connected to the lateral carriage and capable of determining a lateral position of the lateral carriage with respect to a fixed reference.

As used herein, the phrase "step motor" refers to a device operatively connected to the lateral carriage and capable of moving the lateral carriage laterally in predefined increments with respect to a fixed reference. The step motor enables the determination of the lateral position of the lateral carriage with respect to a fixed reference.

As used herein, the terms "calibrating" and "calibration" refer to the validation of sensors. Specifically, a lateral position determination of a sensor is validated by comparing the sensor reading to a known lateral position. In this case, the known lateral position is a measured position of a first portion of the lateral carriage corresponding to a location of the sheet. If inaccuracy is found, the sensor may be adjusted.

As used herein, the phrase "calibration factor" refers to the slope of the sensor, which is referenced in terms of volts per mm (position).

FIG. 1 provides a known sheet registration system 10 for registering a sheet 12 in a printmaking device. The system 10 includes two driven rollers 14, 16 which form nips with idler rolls (not shown). The driven rollers 14, 16 and idler rolls are rotatably mounted and are positioned to drive the sheet 12 in the direction of arrow 18 through the registration system 10. Registration of the sheet 12 is accomplished within a registration distance D between a dashed line 20 and a sheet handoff place 22. A conventional process direction motor 24 imposes an average velocity on the driven rollers 14, 16 and propels the sheet 12 in the process direction 18.

En route to sheet handoff place 22, the sheet 12 encounters a first sensor 26 and a second sensor 28 that are used to measure the lateral and skew position of the sheet 12. These measurements are fed back to a controller (not shown) that manipulates conventional lateral actuator (not shown) and skew actuator (not shown). The first sensor 26 is used for lateral feedback control and the difference in the reported position of the first sensor 26 and the second sensor 28 is used for skew feedback control. The first sensor 26 and the second sensor 28 can be point sensors and may be located in a predetermined position based upon the sheet 12 size or desired media position. A third sensor 30 and a fourth sensor 32 are also included in the system 10 and are configured to detect the arrival of the sheet 12 in the nips of the driven rollers 14, 16 and start the lateral and skew registration.

Figure 2:
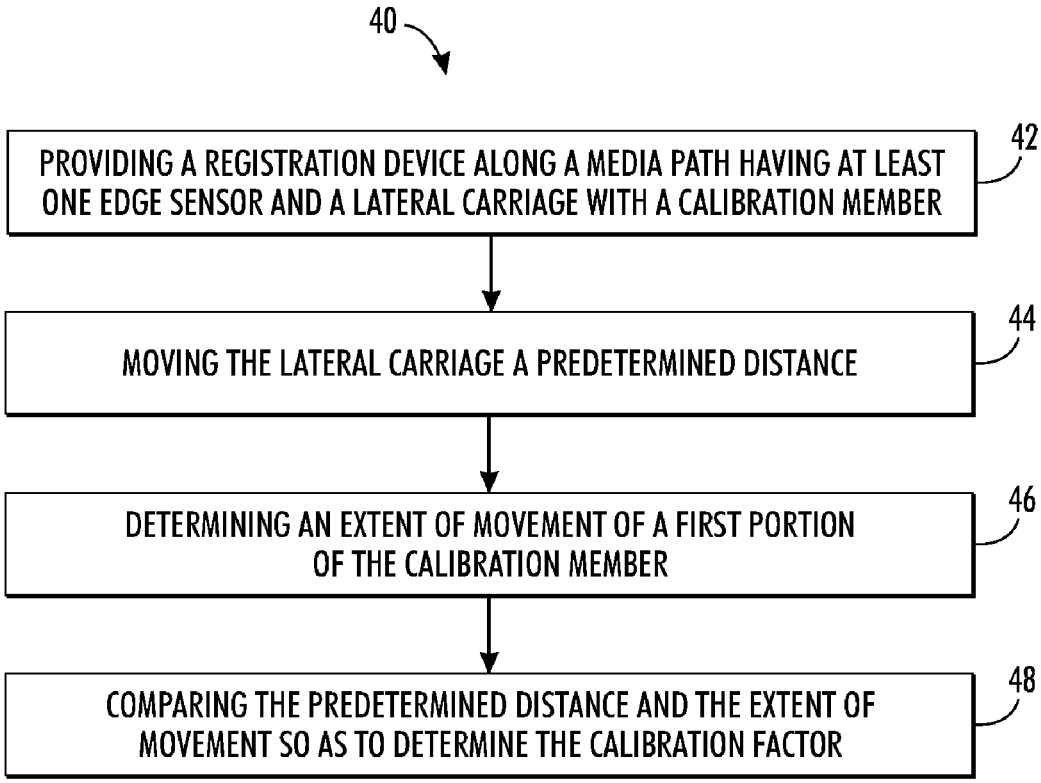
FIG. 2 illustrates a method for calibrating sensors in a sheet registration system for use with a printmaking device.

With reference to FIG. 2, a method 40 for calibrating sensors in a printmaking device is provided. The method calibrates edge sensors using the following steps. In step 42, registration device along a media path is provided. The registration device having a lateral carriage with a calibration member disposed traversely and affixed to the lateral carriage. The registration device including at least one edge sensor. The at least one edge sensor may be configured to determine a lateral position of at least a portion of the calibration member with reference to the media path.

Next, the lateral carriage is moved laterally, a predetermined distance, relative to the media path across the at least one edge sensor, in step 44. Then, the extent of movement of a first portion of the calibration member is determined with reference to the media path in step 46. Finally, step 48 compares the predetermined distance and extent of movement so as to determine the calibration factor.

The steps of method 40 may be repeated multiple times to obtain statistically significant results; for example, 20-30 times. After repeating the steps of the method 40, the extent of movement of the first portion of the calibration member as determined the edge sensors may be averaged to ensure statistical significance. The above calibration steps are performed while the printmaking device is not printing. Moreover, a sheet may be transported along the media path to the registration device 64 after such calibration is completed.

Figure 3:
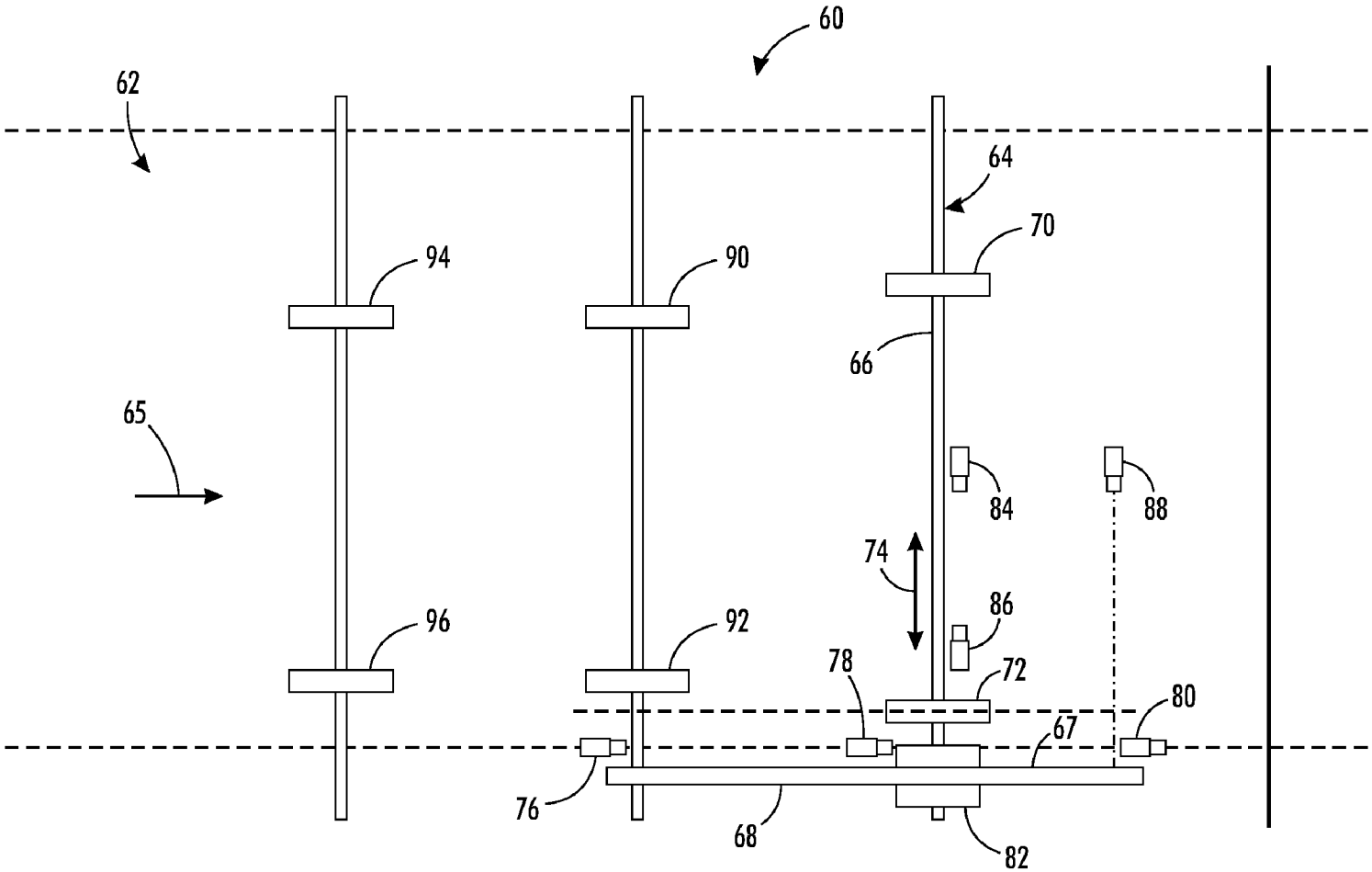
FIG. 3 illustrates a sheet registration system for use with the method of FIG. 2.

FIG. 3 provides an exemplary sheet registration system 60 for use with the method 40 of FIG. 2. The system 60 includes a media path 62, at least one edge sensor, and a registration device 64. The media path 62 is adapted to transport the sheet (not shown), in a process direction 65.

The registration device 64 having a lateral carriage 66 with a calibration member 68 disposed traversely and affixed to the lateral carriage 66. The lateral carriage 66 further including a pair of drive rollers 70, 72 forming nips with idler rollers (not shown). The registration device 64 being configured to move the lateral carriage 66 laterally 74 relative to the media path 62.

The at least one edge sensor is capable of determining lateral positions of at least a portion of the calibration member 68. The at least one edge sensor is illustrated as three edge sensors 76, 78, 80 in the system 60. The three edge sensors 76, 78, 80 may be configured to have high sheet to sheet repeatability. Depending on the system 60 configuration, the system 60 may use only one edge sensor, two edge sensors, or more than three edge sensors with each edge sensor functioning in a manner described herein.

The registration device 64 calibrates at least one edge sensor using the lateral carnage 66. The position of the lateral carnage 66 may be measured by a device 82 operatively connected to the lateral carriage 66 and capable of determining lateral position with reference to the media path 62. The lateral position of the lateral carriage 66 may be determined at a first portion 67 of the calibration member 68, which includes any fixed location on the calibration member 68. For example, a position transducer may be used to measure the lateral position of the lateral carriage 66, which is moved laterally a predetermined distance. A further example includes using a step motor to measure the lateral position of the lateral carriage 66, which is moved laterally in pre-defined increments.

In particular, the registration device 64 provided herein calibrates the at least one edge sensor by: providing the registration 64 along a media path 62 having the lateral carriage 66 with the calibration member disposed traversely and affixed to the lateral carriage 66 and at least one edge sensor configured to determine a lateral position 74 of at least a portion of the calibration member 68 with reference to the media path 62; moving the lateral carriage 66 with the calibration member 68 laterally 74 a predetermined distance relative to the media path 62 across the at least one edge sensor using the device 82, such as a lateral actuator, configured to move the lateral carriage; determining an extent of movement of a first portion 67 of the calibration member 68 using the at least one edge sensor; and comparing the predetermined distance and the extent of movement so as to determine the calibration factor. The above calibration steps may be performed prior to moving the sheet along the media path 62 for printing.

The system 60 of FIG. 3 may further include at least one common sensor configured to detect a process position of the sheet along the media path 62 during printing. FIG. 3 shows three common sensors, 84, 86, 88. The system may also include at least one pair of media path rollers configured to control the sheet along the media path 62 during printing. FIG. 3 shows two pairs of media rollers, 90, 92 and 94, 96.

The system 60 as shown in FIG. 3 is only an example. Thus, for example, the registration device 64 may be located on the opposite end of the media path 62 and the first position 67 of the calibration member 68 may be positioned at another fixed position on the calibration member. Moreover, the registration device 64 may include similar registration devices as may be appreciated by one skilled in the art.

The system 60 may be configured to repeat the calibration of the edge sensors multiple times to obtain statistically significant results. When the calibration is repeated, extent of movement of a first portion 67 of the calibration member 68 as determined by the at least one edge sensors are averaged. After the calibration is completed, the system 60 may resume operation by transporting the sheet along the media path 62 to the registration device 64. Note, the calibration of the at least one edge sensors occurs while the printmaking device is not printing on the sheet.

Figure 4:
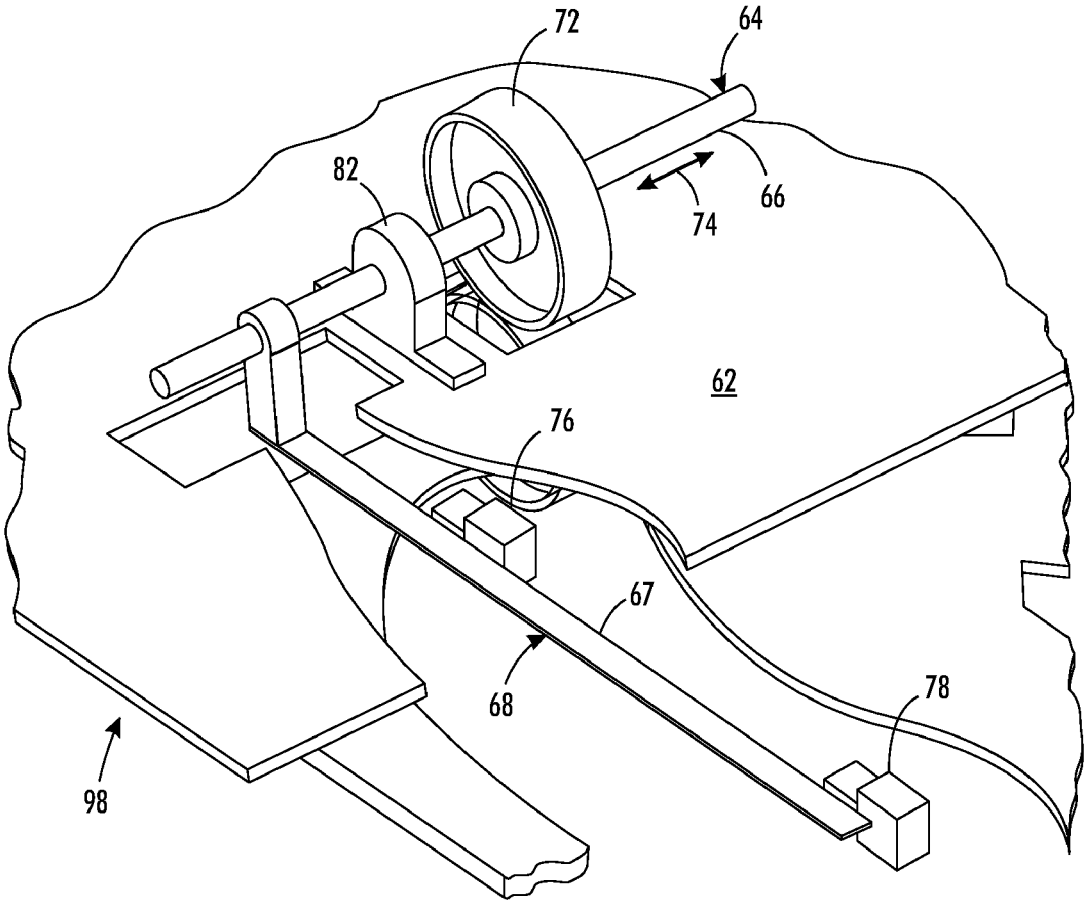
FIG. 4 illustrates an alternate view of a sheet registration system similar to the system of FIG. 3.

With reference to FIG. 4, an exemplary system 98 similar to the system 60 of FIG. 3 is shown. The system 98 of FIG. 4 provides an enlarged view of the registration device 64 with the lateral carriage 66 having the calibration member 68 disposed traversely and affixed to the lateral carriage 66.

Figure 5:
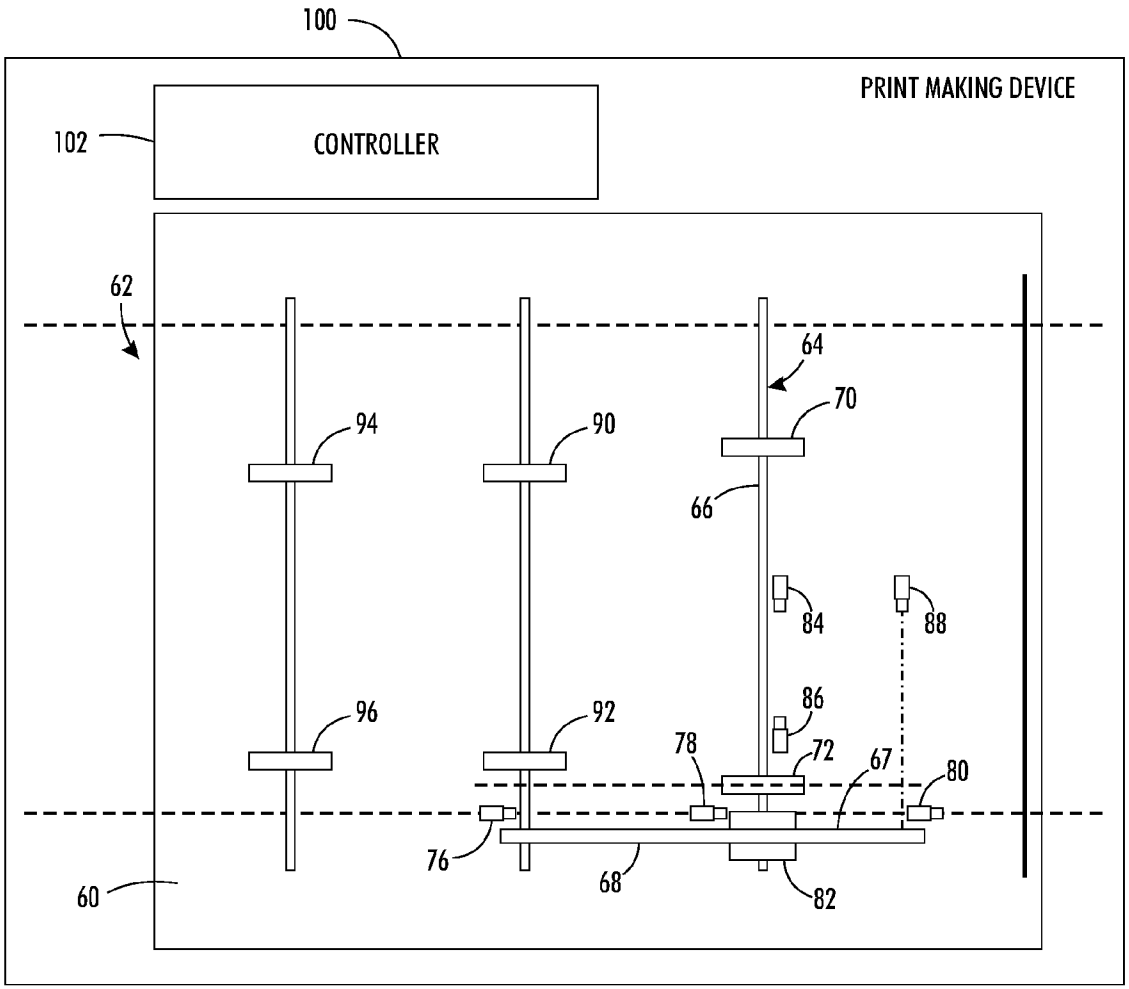
FIG. 5 illustrates a printmaking device for use within the method of FIG. 2, and the system of FIG. 3.

Referring to FIG. 5, an example printmaking device 100 for use with the method 40 of FIG. 2 and the system 60 of FIG. 3 is provided. The printmaking device 100 having a media path 62; a registration device 64, at least one edge sensor, and a controller 102. The controller 102 may be configured to collect and store the predetermined distance the lateral carriage 66 is moved and the extent of movement of thee first portion 67 of the calibration member 68 as determined by the at least one edge sensor. The media path 62 is adapted to transport the sheet, in a process direction 65.

The registration device 64 includes a lateral carriage 66 with a calibration member 68 disposed traversely and affixed to the lateral carriage 66. The lateral carriage 66 further including a pair of drive rollers 70, 72 forming nips with idler rollers (not shown). The registration device 64 being configured to move the lateral carriage 66 laterally 74 relative to the media path 62.

The registration device 64 calibrates at least one edge sensor using the lateral carriage 66. The position of the lateral carriage 66 may be measured by the device 82 operatively connected to the lateral carriage 66 and capable of determining lateral position with reference to the media path 62. The lateral position of the lateral carriage 66 may be determined at a first portion 67 of the calibration member 68, which includes any fixed location on the calibration member 68. For example, a position transducer may be used to measure the lateral position of the lateral carriage 66, which is moved laterally a predetermined distance. A further example includes using a step motor to measure the lateral position of the lateral carriage 66, which is moved laterally in pre-defined increments.

The at least one edge sensor is capable of determining lateral positions of at least a portion of the calibration member 68. The at least one edge sensor is illustrated as three edge sensors 76, 78, 80, which may be configured to have high sheet to sheet repeatability. The edge sensors 76, 78, 80 are located along the media path 62 and configured to determine a position of the calibration member 68 with high sheet to sheet repeatability. Although three edge sensors 76, 78, 80 are shown in this example, the printmaking device 100 only needs at least on edge sensor to work as discussed herein.

The printmaking device 100 calibrates the at least one edge sensor, while the printmaking device 100 is not printing, using the following steps: providing the registration 64 along the media path 62 having the lateral carriage 66 with the calibration member disposed traversely and affixed to the lateral carriage 66 and the at least one edge sensor configured to determine the lateral position 74 of at least a portion of the calibration member 68 with reference to the media path 62; moving the lateral carriage 66 with the calibration member 68 laterally 74 a predetermined distance relative to the media path 62 across the at least one edge sensor using the device 82, such as a lateral actuator, configured to move the lateral carriage; determining the extent of movement of a first portion 67 of the calibration member 68 using the at least one edge sensor; and comparing the predetermined distance and the extent of movement so as to determine the calibration factor. The above calibration steps may be performed prior to moving the sheet along the media path 62 for printing.

The system 60 may be configured to repeat the calibration of the edge sensors multiple times to obtain statistically significant results. When the calibration is repeated, the three sensor outputs 112, 114, 116 as determined by the edge sensors 76, 78, 80 are averaged. After the calibration is completed, the system 60 may resume operation by transporting the sheet along the media path 62 to the registration device 64.

Note, the calibration of the edge sensors 76, 78, 80 occurs while the printmaking device 100 is not printing on the sheet.

Figure 6:
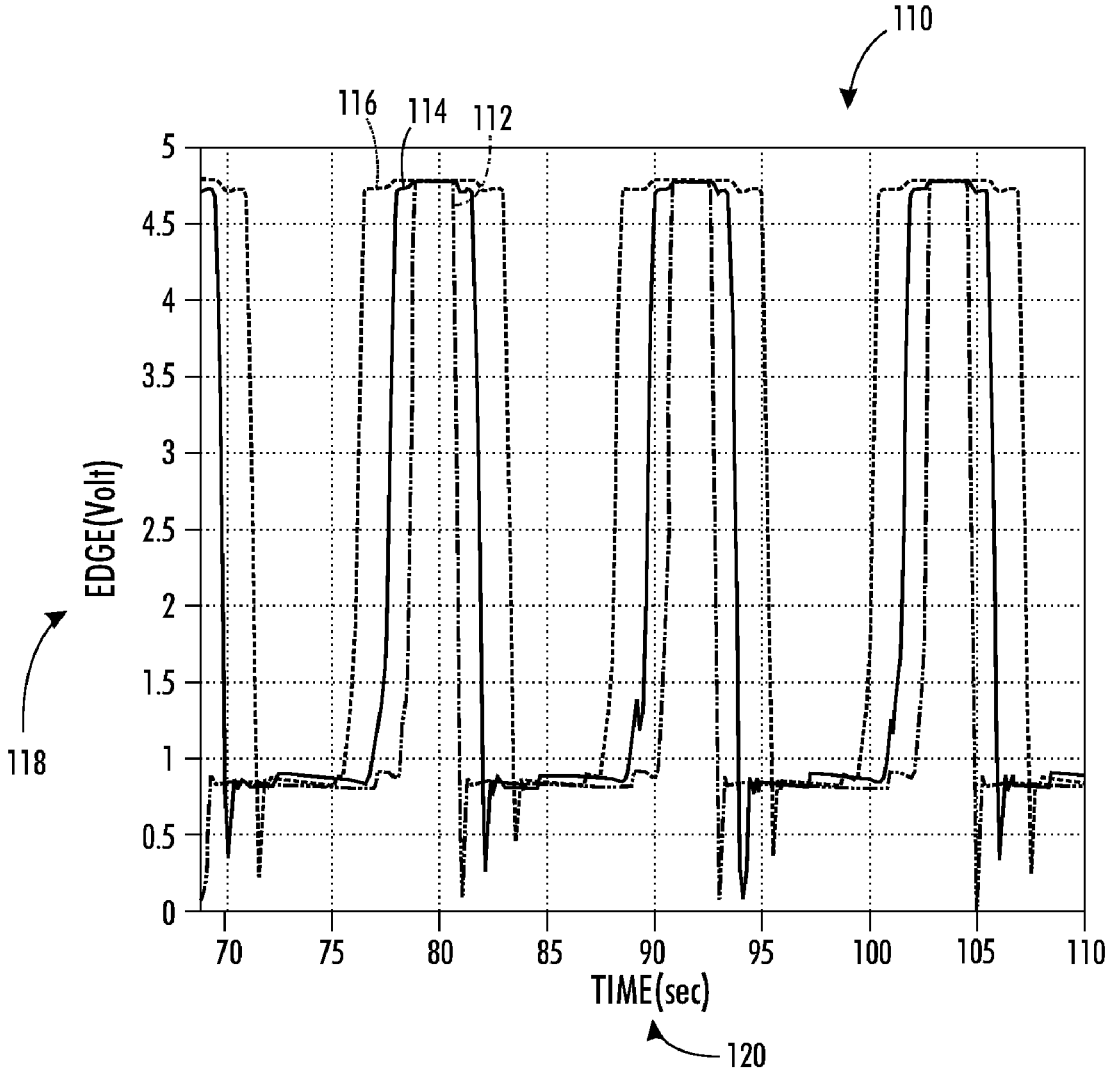
FIG. 6 illustrates a calibration curve based on an extent of movement as determined by the three edge sensors as a first portion of the calibration member is moved laterally multiple times using the method of FIG. 2.
Figure 7:
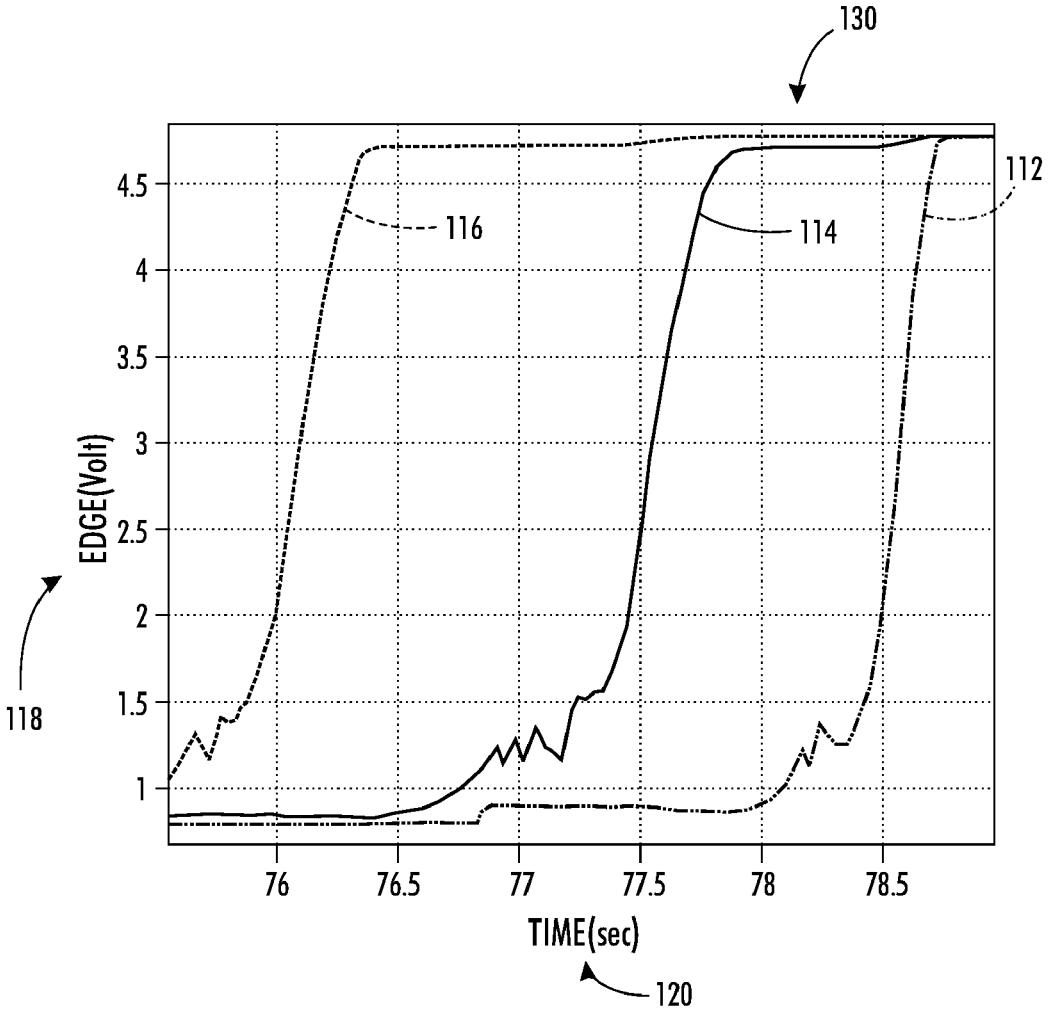
FIG. 7 illustrates a partial view of the calibration curve of FIG. 4.

With reference to FIGS. 6-7, an example of a graph 110 plotting the lateral movement 74 of the calibration member 68. The graph 110 of FIG. 6 depicts the determined extent of movement of the first portion 67 of the calibration member 68 of the three edge sensors 76, 78, 80, and plots the calibration member's 68 movement as three edge sensor outputs 112, 114, 116, in terms of volts 118, as a function of time 120. FIG. 6 is an example of the three sensor outputs 112, 114, 116 as the calibration member 68 crossed each of the three edge sensors 76, 78, 80 three times. For statistical averaging the method would be performed approximately 20 to 30 times and each iteration may be plotted as shown in FIG. 6.

Specifically, in FIGS. 6-7 the x-axis is the time 120, which may be converted to a distance position 132 by multiplication with the velocity, and the y-axis shows the three sensor outputs 112, 114, 116 as determined by each of the sensors 76, 78, 80, which are outputted in terms of voltage 118 in this case. The slope is shown in FIG. 6 as the calibration member 68 crosses the edge sensor going both ways, i.e. laterally 74 towards the three edge sensors 76, 78, 80 and laterally 74 away from the edge sensors 76, 78, 80. As the calibration member 68 moves laterally 74 towards the edge sensors 76, 78, 80, the volts 118 are plotted in FIGS. 6-7 as increasing. Conversely, as the calibration member 68 moves laterally 74 away from the edge sensors 76, 78, 80, the volts 118 are plotted in FIGS. 6-7 as decreasing. Using the values plotted in FIGS. 6-7, the slope of the three sensor outputs 112, 114, 116 may express the sensor gain in terms of volts 118 per position.

This exemplary plot 110 has a registration device 64 with a step motor attached to the lateral carriage 66, which causes the lateral movement 74. The step motor is driven at a constant frequency and hence the calibration member 68 moves at a constant velocity of 2.5 mm/s in this example. Using the constant velocity, the calibration member 68 position may be calculated by integrating the velocity over time. Thus, the three sensor outputs 112, 114, 116, as determined by the three sensors 76, 78, 80 may be known as a function of the calibration member 68 position.

FIG. 7 provides a partial view of the graph 110 of FIG. 6, focusing on one interval of time 120, approximately 76 to 78.5 seconds, of the first portion 67 of the calibration member 68 moving laterally 74 towards the edge sensors 76, 78, 80 and crossing the edge sensors 76, 78, 80. Like FIG. 6, the partial view of the graph 110 shows the variation of the three sensor outputs 112, 114, 116 as determined by the three sensors 76, 78, 80 as a function of time 120 and hence position, since the velocity is constant and known.

Figure 8A:
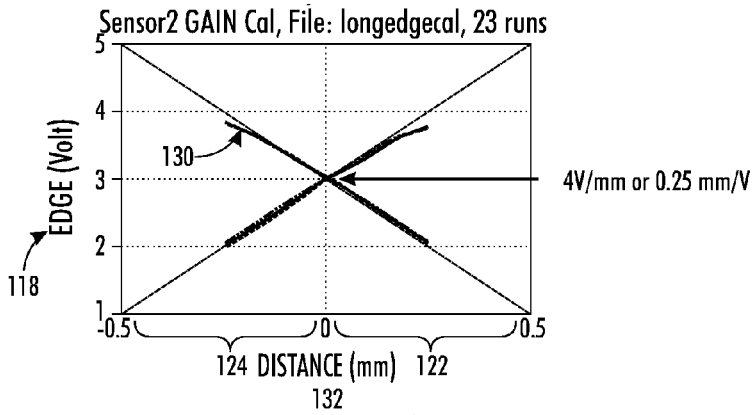
FIGS. 8A-C illustrate graphs of a linear gain for each of the three sensors in FIGS. 6-7.
Figure 8B:
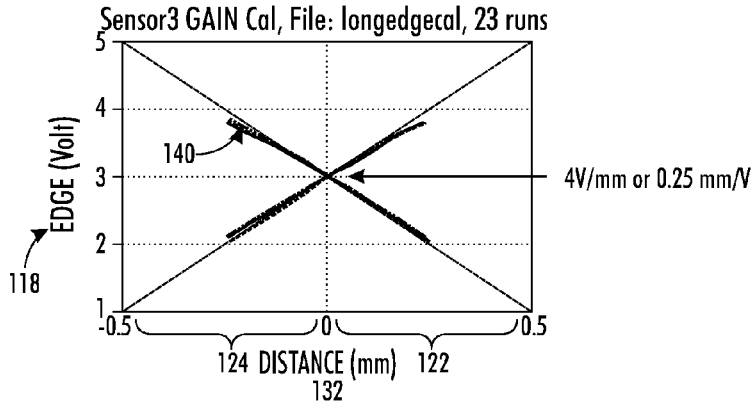
Figure 8C:
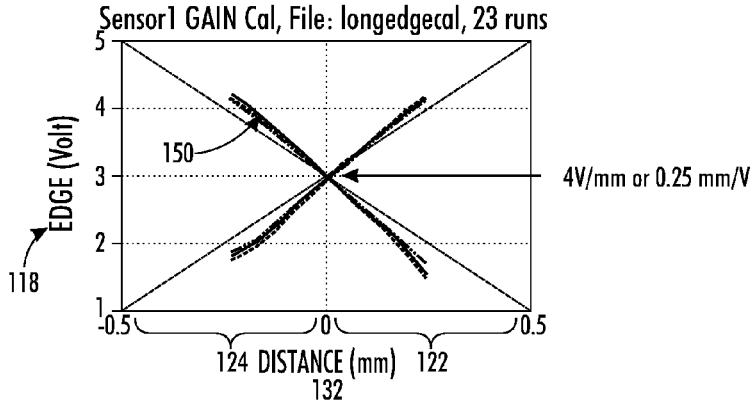

Referring to FIGS. 8A-C, calibration curves are provided with the determinations recorded from multiple iterations of the calibration member 68 crossing the edge sensors 76, 78, 80 all plotted on top of each other. The outputs relating to the calibration member 68 moving laterally 74 towards the edge sensors 76, 78, 80 represented with the positive plotted x-values 122, and the outputs relating to the calibration member 68 moving laterally 74 away from the edge sensors 76, 78, 80 represented with the negative plotted x-values 124. To plot the outputs, the recordings in the graph of FIG. 6 are shifted in time 120 and the time 120 was converted to a distance position 132 by multiplying time 120 by the velocity. The three sensor outputs 112, 114, 116 are outputted in volts 118 and are the same as in FIGS. 6-7. Additionally, by averaging each of the three sensor outputs 112, 114, 116, an average sensor reading as a function of the distance position 132 may be obtained for each edge sensor 76, 78, 80.

FIG. 8A plots 130 outputs 114 from the second sensor 78 in terms of voltage 118 and the distance position 132 recordings. Outputs 116 from the third sensor 80 are plotted 140 in 8B in terms of voltage 118 and the distance position 132 recordings. FIG. 8C shows the first sensor 76 outputs 112 plotted 150 in terms of voltage 118 and the distance position 132 recordings.

FIGS. 8A-C include dashed lines to help determine the approximate linear gain or slope. The dashed lines represent the predetermined lateral movement of the lateral carriage 66. By plotting the lateral movement of the lateral carriage 66 and the three sensor outputs 112, 114, 116 on the same graph, the linear gain may be easily viewed. FIG. 8A-C show an approximate linear gain of 4 V/mm in this example. This approximation is very good for sensors 2 and 3 shown in FIGS. 8A-B, but sensor 1 as plotted in FIG. 8C needs an adjustment.

Additionally, the method 40 provided herein may be used to determine edge positions when the three sensor outputs 112, 114, 116 as shown in FIGS. 6, 7, and/or 8A-C are known. The inverse of the average sensor reading, which is 0.25 mm/V in this case, yields a distance position 132 as a function of the sensor reading, which can be used by a sheet servo controller, registration controller or other device to convert the three sensor outputs 112, 114, 116 to edge position. The averaged sensor determinations and the inverse may be curve fitted or used with table look-up methods with interpolation/extrapolation.

The benefit of the system and method provided herein include the ability to easily calibrate sensors prior to printing to increase the accuracy of the print job. An additional benefit is the ability to use low cost sensors that can be calibrated using the method provided herein without compromising precision and accuracy of the sensors. In fact, use of low cost sensors with the method of calibration provided herein may even provide for the sensors being more precise.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A printmaking device comprising:

a calibration system including:

a media path adapted to transport a sheet;

a registration device having a pair of nips connected by a lateral carriage, said lateral carriage including a calibration member disposed traversely and affixed to said lateral carriage, wherein said lateral carriage is configured to move laterally relative to said media path; and at least one edge sensor along said media path, said at least one edge sensor being configured to determine an extent of movement of a first portion of said calibration member;

wherein said registration device calibrates said at least one edge sensor by:

moving said lateral carriage a predetermined distance;

determining said extent of movement of said first portion of said calibration member; and comparing said predetermined distance and said extent of movement so as to determine a calibration factor.

2. The device of claim 1, wherein the calibration factor is calculated while the printmaking device is not printing.

3. The device of claim 1, wherein a position transducer is used to measure a lateral position of said first portion of said calibration member.

4. The device of claim 1, wherein a step motor is used to move said first portion of said calibration member along a set of predefined incremental lateral positions.

5. The device of claim 1, wherein said at least one edge sensor is configured to have high sheet-to-sheet repeatability.

6. The device of claim 1, wherein a sheet is transported along said media path to said registration device after said at least one edge sensor is calibrated.

7. A method for calculating a calibration factor for at least one edge sensor in a printmaking device comprising:

providing a registration device along a media path having a lateral carriage with a calibration member disposed traversely and affixed to said lateral carriage, and at least one edge sensor configured to measure a lateral position of at least a portion of said calibration member with reference to said media path;

moving said lateral carriage a predetermined distance;

determining an extent of movement of a first portion of said calibration member; and comparing said predetermined distance and said extent of movement so as to determine a calibration factor.

8. The method of claim 7, wherein a sheet is transported along said media path to said registration device after said at least one edge sensor is calibrated.

9. The method of claim 7, wherein said at least one edge sensor is configured to have high sheet-to-sheet repeatability.

10. The method of claim 9, wherein the calibration factor is calculated while the printmaking device is not printing.

11. The method of claim 7, wherein a position transducer is used to measure a lateral position of said first portion of said calibration member.

12. The method of claim 7, wherein a step motor is used to move said first portion of said calibration member along a set of predefined incremental lateral positions.

13. The method of claim 7, wherein the steps moving said lateral carriage, determining said extent of movement, and comparing are repeated and recorded multiple times.

14. The method of claim 13, wherein a calibration curve is obtained by plotting on a graph each of determined said extent of movement.

15. The method of claim 13, wherein multiple recordings of said extent of movement of said first portion of said calibration member are averaged to ensure statistically significant results.

16. A system for use with a printmaking device to calculate a calibration factor for at least one edge sensor comprising:

a media path adapted to transport a sheet;

a registration device having a pair of nips connected by a lateral carriage, said lateral carriage including a calibration member disposed traversely and affixed to said lateral carriage, wherein said lateral carriage is configured to move laterally relative to said media path; and the at least one edge sensor along said media path, the at least one edge sensor being configured to determine an extent of movement of a first portion of said calibration member;

wherein said registration device calibrates said at least one edge sensor by:

moving said lateral carriage a predetermined distance;

determining said extent of movement of said first portion of said calibration member; and comparing said predetermined distance and said extent of movement so as to determine a calibration factor.

17. The system of claim 16, wherein the calibration factor is calculated while the printmaking device is not printing.

18. The system of claim 16, wherein a position transducer is used to measure a lateral position of said first portion of said calibration member.

19. The system of claim 16, wherein a step motor is used to move said first portion of said calibration member along a set of predefined incremental lateral positions.

20. The system of claim 16, wherein said at least one edge sensor is configured to have high sheet-to-sheet repeatability.

21. The system of claim 16, wherein a sheet is transported along said media path to said registration device after said at least one edge sensor is calibrated.

* * * * *